United States Patent [19]

Sprague

[11] 3,948,030

[45] Apr. 6, 1976

[54] SPINDLE PROTECTION DEVICE

[75] Inventor: Frederick L. Sprague, Hopedale, Mass.

[73] Assignee: Rockwell International Corporation, Pittsburgh, Pa.

[22] Filed: June 13, 1975

[21] Appl. No.: 586,530

[52] U.S. Cl. ..... 57/53

[51] Int. Cl.[2] ..... D01H 9/10

[58] Field of Search ..... 57/52, 53, 54, 34 R; 242/41

[56] References Cited

UNITED STATES PATENTS

| | | | |
|---|---|---|---|
| 3,070,949 | 1/1963 | Du Buis et al. | 57/53 |
| 3,077,725 | 2/1963 | Du Buis et al. | 57/53 |
| 3,088,266 | 5/1963 | Bahnson, Jr. et al. | 57/53 |
| 3,321,896 | 5/1967 | King, Jr. et al. | 57/53 |
| 3,321,897 | 5/1967 | Cugini et al. | 57/53 |

*Primary Examiner*—John Petrakes

[57] ABSTRACT

An improved spindle protection device for a combined donning and doffing machine adapted to impale and doff bobbins from a row of spindles supported on a spinning frame. The device is effective in initiating movement of the machine's donning apparatus to an inactive position in the event a wound bobbin fails to be doffed from its respective spindle.

4 Claims, 5 Drawing Figures

SPINDLE PROTECTION DEVICE

BACKGROUND OF THE INVENTION

1. Field of the Invention

The present invention is applicable to a doffing and donning machine such as that disclosed in U.S. Pat. No. 3,077,725 and since this patent may be referred to for a more detailed description of such a machine, it is considered unnecessary at this point to insert herein the details of the general aspects of construction and operation of this unit.

This doffing and donning unit as disclosed in the above patent is adapted to be mounted by rollers on a rail fixed to a spinning frame and is designed to move along and in close proximity with a row of spindles supported by said spinning frame. The machine includes adjacently situated and vertically disposed doffing and donning mechanisms which are individually movable in a lateral direction to and away from operating position.

When these mechanisms are in operating position and the machine is being moved along the rail of the spinning frame, the wound or full bobbins are first doffed from their respective spindles and the donning mechanism being adjacently disposed on said machine is brought into operation by continued movement of the machine to don or impale empty bobbins on those spindles from which the doffing mechanism had removed the full bobbins.

2. Description of the Prior Art

The donning mechanism when in operating position is disposed above the row of spindles with only sufficient clearance between the top of the doffed spindles and said mechanism to permit uninterrupted advancement of the machine along the spinning frame. This limited amount of clearance between the spindle and the donning mechanism will cause the upper portion of an undoffed bobbin to come into contact with the donning mechanism to create a jamming condition resulting oftentimes in a bent and damaged spindle.

U.S. Pat. No. 3,321,897 shows and describes one form of a spindle protection device for deactivating the donning mechanism in the event a wound bobbin fails to be doffed from its respective spindle. The device of this patent utilizes a pivotal indicating lever and latching pawl arrangement which are interconnected by a camming member and mechanical linkages. The indicating lever is disposed so as to be engaged by an undoffed bobbin and by means of the camming member and mechanical linkage operatively associated with said lever, the latching pawl arrangement is actuated to release the donning device so that it will retract to an inoperative position.

The distance between spindles on a spinning frame can vary between two-and-one-half and three-and-one-half inches, and the donning and doffing machine is designed so that wound bobbins are being doffed two to three spindles ahead of those spindles on which empty bobbins are being impaled by the donning mechanism. The machine is manually pushed by an operator along the rail of a spinning frame at a speed approximately equivalent to a normal walking pace. The speed at which the machine is moved along the rail of a spinning frame, and the distance between the spindles being doffed of wound bobbins and those impaled with empty ones coupled with the wellknown condition of lost motion and delays which are frequently present in the means for actuating devices that are controlled solely by mechanical means, it has been considered advantageous and desirable to provide a spindle protection device which is effective in deactivating the donning mechanism in a shorter period of time than has been heretofore possible.

The spindle protection device comprising the invention provides a means which instantly transmits an indication of an undoffed bobbin to effect release of the donning mechanism to its inoperative position and eliminates all possibility of an undoffed bobbin from contacting said donning mechanism and the resulting damage described above.

SUMMARY OF THE INVENTION

The spindle protection device for donning and doffing machines of the present invention includes a pivotable bobbin indicating lever carried by said machine disposed above and in close proximity with the spindles when the machine is mounted on a spinning frame. Operatively associated with the indicating lever the device further includes a switch member that is interconnected with a latching pawl which is pivotal to and from positions for locating the donning mechanism in its operating position. The means interconnecting the switch member with the latching pawl includes a self-contained energy package mounted on the donning and doffing machine with a solenoid member connected thereto having a reciprocable core that is operatively connected to said latching pawl. The self-contained energy package comprises a battery element and associated circuitry arranged so as to permit the drawing of electrical energy only when the switch member is triggered by pivotal movement of the indicating lever.

It is a general object of the invention to provide an improved means of preventing damage to spindles by the donning mechanism in the event of a doffing miss.

A further object is to provide a spindle protection device which is effective in deactivating the donning mechanism more quickly than has been heretofore possible should a wound bobbin fail to be doffed from its respective spindle.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
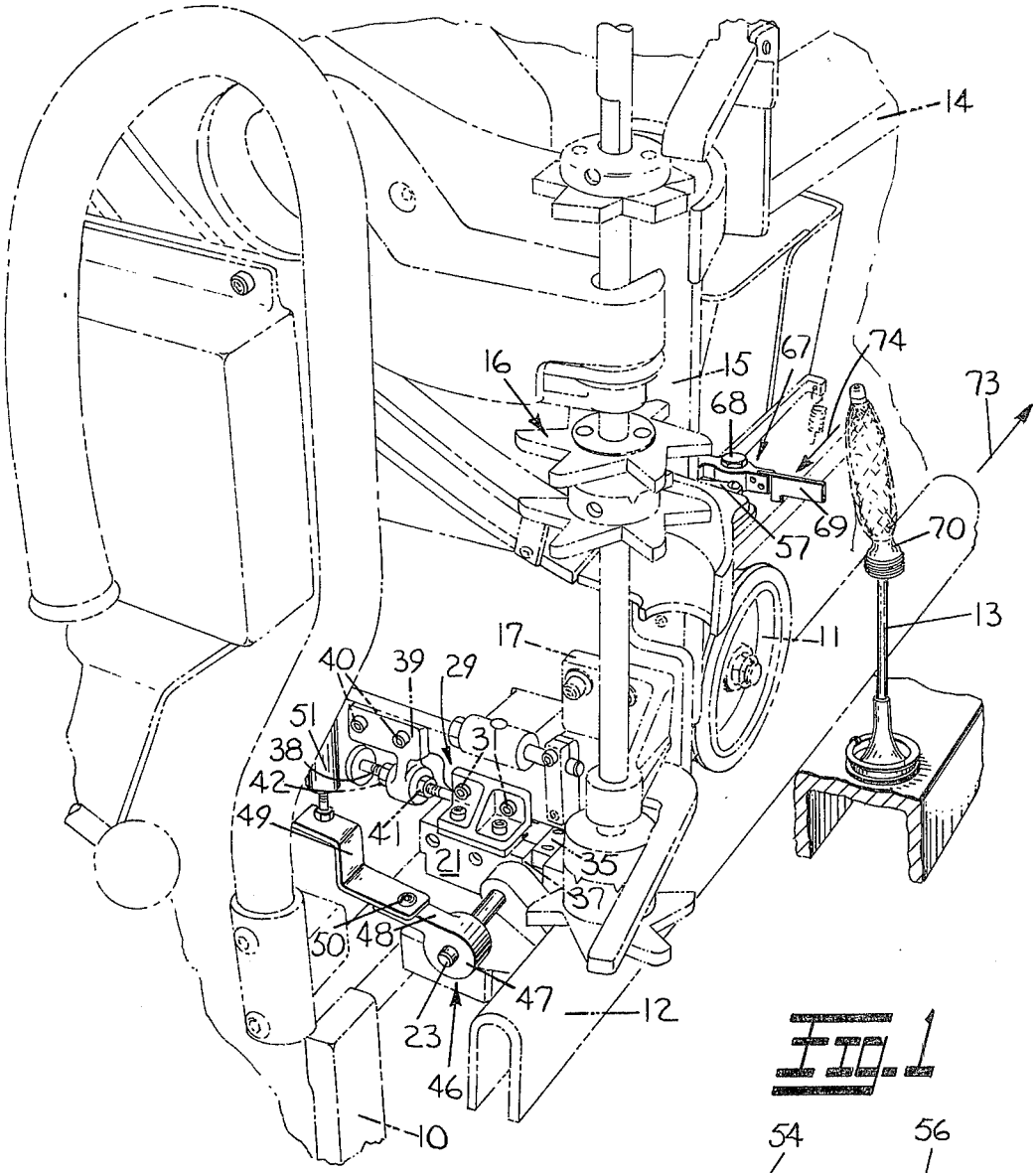
FIG. 1 is a perspective view depicting only so much of the donning and doffing machine's structure as is necessary to a full understanding of the invention, with the spindle protection device according to the invention applied thereto.

Referring now to the figures of drawing, enough of a combined donning and doffing machine has been illustrated in FIG. 1 to serve as a basis for a detailed description of the invention applied thereto.

A portion of the machines supporting framework is identified by numeral 10 and includes rollers 11 (one only shown in FIG. 1) which serve as a means for mounting the machine on a rail 12 of a spinning frame and for moving the same along said frame and in close proximity with a row of spindles 13 supported thereby (one only shown).

Supported above the framework a carriage 14 extends longitudinally for a portion of the length of the machine and carries a means on one end thereof (not shown) for slidably supporting a vertical plate 15. This vertical plate 15 is slidable in a direction normal to the direction of movement of the machine, and is slidably on its means of support from a retracted position (FIG. 3) to a projected position illustrated in FIG. 1.

The donning mechanism is identified generally in FIG. 1 by numeral 16 and is assembled on one side of the vertical plate 15 as at 17, and being movable with said vertical plate, it is properly located when in the projected position of FIG. 1 for donning empty bobbins on the spindles directly below said mechanism.

Figure 3:
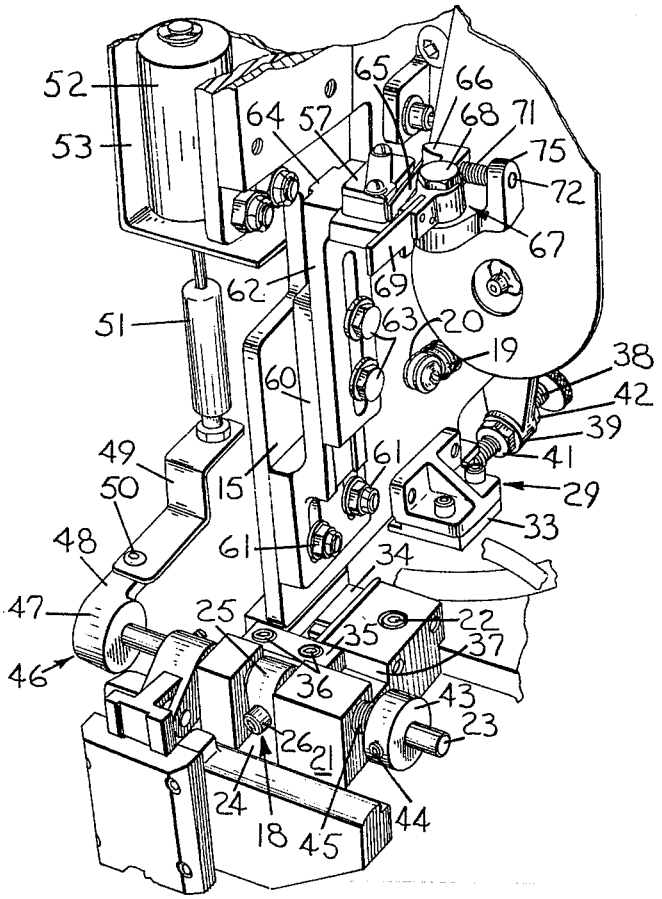
FIG. 3 is a perspective view showing the plate member on which the donning mechanism is carried in a retracted position along with the latching means therefor and the latter's connection to the solenoid.
Figure 4:
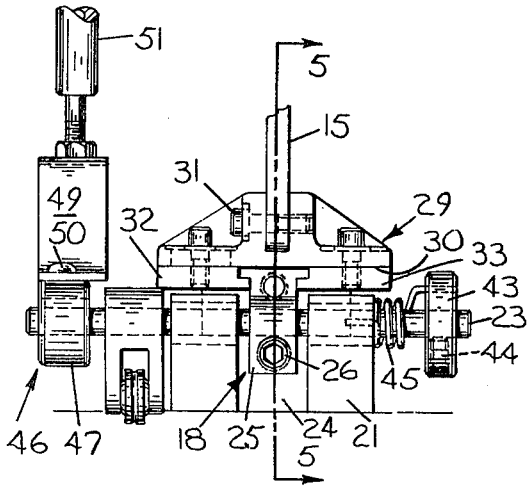
FIG. 4 is an elevational view of the latching means shown in FIG. 3.
Figure 5:
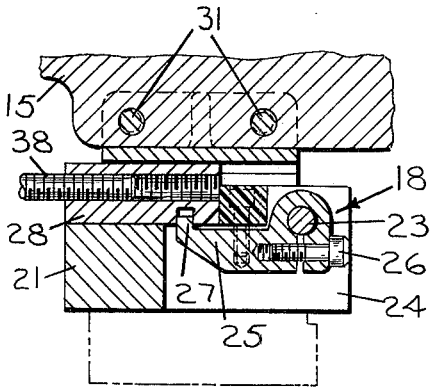
FIG. 5 is a sectional view taken along line 5—5 in FIG. 4.

The vertical plate 15 when in a projected position, is maintained in this position by a latching mechanism generally indicated by numeral 18 (FIGS. 3, 4 and 5). A coil spring member 19 (FIG. 3) having one end attached to the vertical plate as at 20 and the opposite end (not shown) being suitably attached to the means for slidably supporting said plate, continually urges the latter to its retracted position. The release of the latching mechanism, which will be more fully described hereinafter, allows spring 19 to retract and in so doing withdraws the vertical plate 15 and the donning mechanism 16 supported thereby to an inactive and withdrawn position.

The latching mechanism includes a latch-out block 21 which is attached to a horizontally disposed portion of the supporting framework by cap screws 22 (one only shown in FIG. 3). A horizontally disposed and longitudinally extending shaft member 23 assembles within the latchout block 21 and extending from opposite ends thereof, the ends support fixedly attached members to be more fully described that are instrumental in transmitting the required rotary motion to shaft member 23 to release the donning mechanism for retraction to an inactive position as well as effecting the locking of said mechanism in the projected position.

The latching mechanism referred to above is housed within the latch-out block 21 which is provided with a centrally disposed recess 24 extending from that side of the block adjacent the donning mechanism's operating position inwardly for a portion of said blocks width. Shaft member 23 extends through recess 24 and is journalled in aligned apertures provided in that portion of the block which form the sides of said recess.

A latching pawl 25 (FIGS. 3, 4 and 5) is fixed on shaft 23 by means of a screw 26 and being disposed within the recess 24 it is movable with said shaft to hold the vertical plate 15 in a projected position as well as to release the same therefrom. This latching pawl is provided with a latching tooth 27 (FIG. 5) which when in locking position is adapted to seat in a recess of conforming configuration provided in a latch-out bracket 28.

FIGS. 4 and 5 illustrate the means utilized to attach the latch-out bracket 28 to the underside of the vertical plate 15 and includes a mounting bracket generally indicated by numeral 29 having a horizontally disposed base portion 30 which attaches to the lower edge of said vertical plate by means of cap screws 31.

A pair of stepped channel plates 32 and 33 assemble in spaced relation (FIG. 4) to the underside of base portion 30 and forms a guiding channel between said plates for assembly of the latch-out bracket 28.

Continuous with recess 24 a guiding channel 34 (FIG. 3) is provided on the upper portion of the latch-out block 21 and serves as a guide for the latch-out bracket 28 so as to maintain the vertical plate 15 in general vertical alignment when in a projected position.

The latch-out bracket 28 when projected with the vertical plate 15 moves to a predetermined position in channel 34 where it is caused to come into contact with a stop member 35. This stop member is made of a wear resistant material and assembles by means of cap screws 36 in a longitudinally extending channel 37 (FIGS. 1 and 3) which communicates with recess 24 and channel 34 and extends in a direction normal thereto. The latch-out bracket 28 is adjustable within the channel formed by plates 32 and 33 and serves as a means whereby the donning mechanism which is supported on plate 15 may be adjusted to obtain the desired alignment with the spindles with which is cooperates during its intended function. This adjustment feature includes an adjustment screw 38 (FIGS. 1 and 5) that is supported intermediate its ends by a depending support member 39 the upper portion of which attaches to the lower side of plate 15 by means of cap screws 40. Adjusting screw 38 is provided with lock nuts 41 and 42 which are adapted to be tightened against the depending support member 39 to maintain the plate 15 in its required setting. To advance or withdraw the plate and donning mechanism for adjustment purposes, lock nuts 41 and 42 are loosened and turning of the adjustment screw, one end of which is rotatably attached to the latch-out bracket 28, will cause the latter to slide in one direction or the other within the channel formed by plates 32 and 33. Retightening of the lock nuts will maintain the changed setting and when plate 15 is again projected, the latch-out bracket will still make contact with the stop member 35, but the position of said plate and donning mechanism with respect to the spindle is affected by the adjustment means.

Now there will be described the means by which the latching pawl is actuated to hold the donning mechanism in its operating position and to release the same therefrom. With reference to FIGS. 3 and 4 one end of shaft 23 which protrudes from the latch-out block 21 has a spring collar 43 fixed thereon by means of a set screw 44 and is located in spaced relation to the side of said latch-out block. The shaft has a torsion spring 45 assembled thereon in the space intermediate collar 43 and the side of the block with the ends of said spring being assembled in apertures provided in said block and collar (FIG. 4). Torsion spring 45 provides the means for continually urging shaft 23 in a clockwise direction as viewed in FIGS. 3 and 5 and serves to bias the latching pawl 25 in the direction of its latching position shown in FIG. 5.

Figure 2:
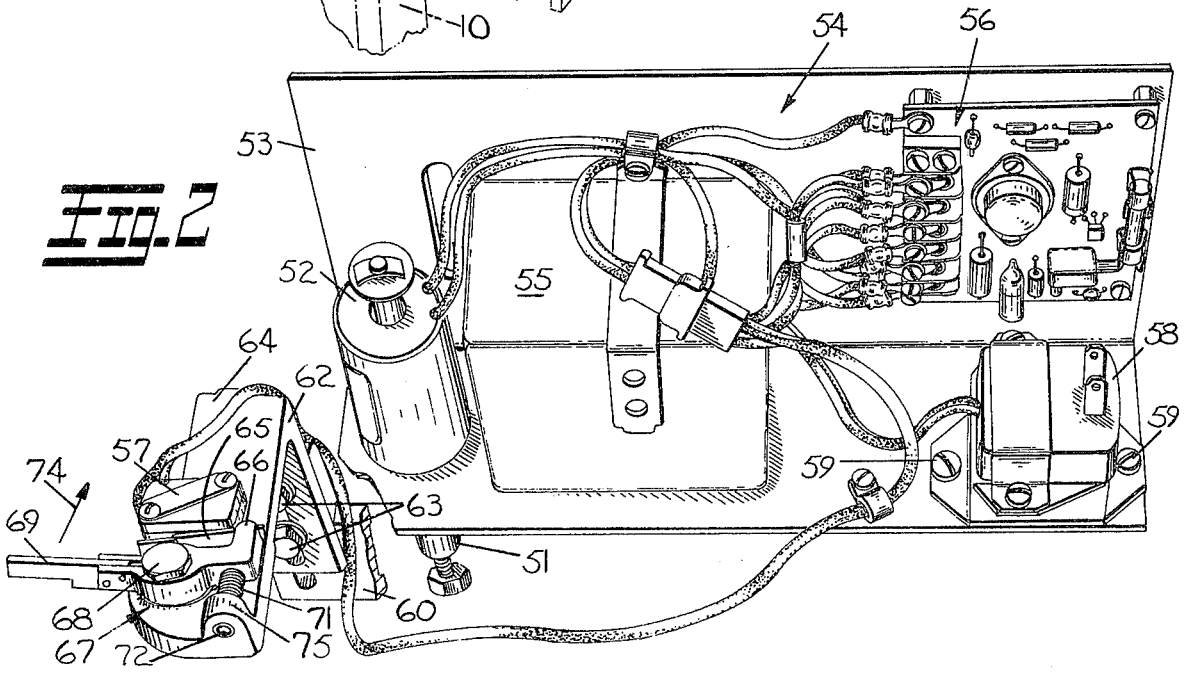
FIG. 2 is a perspective view of the self-contained energy package carried by the machine showing its connections to the indicating lever and the solenoid.

The opposite end of shaft 23 has an actuating lever fixed thereon which is identified generallly by numeral 46 and includes a hub portion 47 and an integrally formed arm 48 extending therefrom. An offset finger element in the form of a strap 49 has one end thereof fixed to arm 48 by any suitable means such as a rivet 50 and the opposite end is in operative association with a reciprocable core 51 of a solenoid 52. This solenoid is carried on a support shelf 53 which is carried by the machine and is connected to a self-contained energy package also supported on said shelf and which is identified generally by numeral 54 in FIG. 2. This energy package includes a 12 volt battery 55 and associated circuitry generally indicated in FIG. 2 by numeral 56 which is arranged so as to draw from the battery only upon actuation or the opening of a normally closed switch 57 connected therewith. One type of battery which may be utilized with this energy package is that sold under the trade name of Energette by Delco Remy Div. of General Motors Corp.

For the purpose of maintaining the charge of the battery 55 at optimum level a recharging unit 58 is interconnected with said battery and is mounted on the support shelf 53 by means of screws 59.

With reference to FIG. 3 an upwardly directed mounting bracket 60 is assembled to the vertical plate 15 by means of bolts 61 and has an inverted L-shaped bracket 62 adjustably assembled thereto by means of bolts 63. The upper surface of bracket 62 defines a shelf 64 (FIG. 2) having an upwardly directed and integrally formed lug 75 on the terminus portion thereof.

The normally closed switch 57 is fixed on shelf 64 and includes an actuating lever 65 disposed for operative association with a first arm 66 of a double armed lever generally indicated by numeral 67. This double armed lever 67 is pivotally mounted on shelf 64 by means of a bolt 68 and includes a second arm that defines a bobbin indicating lever 69 which extends from the machine and which is adapted to engage a wound bobbin 70 (FIG. 1) should the latter fail to be doffed from its respective spindle 13. Intermediate the lug 65 and the first arm 66 of the double armed lever 67 a coil spring 71 assembles on a pin 72 and serves to continually urge said first arm 66 into contact with the actuating lever 65 of the switch 57 to prevent triggering of the latter unless the indicating lever 69 is pivoted by means of contact with an undoffed bobbin.

To summarize the operation, the machine when moving along the rail of a spinning frame is moving in the direction of the indicating arrow 73 in FIG. 1 and the wound bobbins are first doffed from their respective spindle by the doffing mechanism and then empty bobbins are impaled on these spindles by means fully described in the aforementioned patent. The protection device according to the invention is located intermediate the doffing and donning mechanisms and functions to detect wound bobbins remaining on the spindle after passing the doffing mechanism.

FIG. 1 illustrates the indicating lever 69 in operating position whereat it will not contact the empty spindles as it moves past them; however, should there by a doffing miss as shown in FIG. 1 said indicating lever will contact the wound bobbin and be caused to pivot in the direction of the indicating arrow 74 in this figure of drawing.

Pivotal movement of the indicating lever 69 in this manner will pivot the first arm 66 to a position which will allow the actuating lever 66 to move a sufficient distance so as to open or actuate switch 57. Actuation of switch 57 will by means of battery 55 and circuitry associated therewith immediately energize the solenoid 52 causing its reciprocable core 51 to move in a downwardly direction. With this reciprocable core being operatively connected to shaft member 23 its downward movement will rotate said shaft in a direction to cause the latching pawl 25 carried thereon to become disengaged from the latchout bracket 28 and coil spring 19 will then retract the vertical plate 15 to a position which places the donning mechanism in its inactive position.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. For a machine adapted to move along a spinning frame having mechanisms for donning empty bobbins on and doffing wound bobbins from a row of spindles supported by the spinning frame, a spindle protection device comprising:

a. a pivotable bobbin indicating lever;

b. a latching means for maintaining the donning mechanism in operating position including means operatively associated with said indicating lever for releasing said donning mechanism when said indicating lever is encountered by an undoffed wound bobbin, said means including:

1. a switch member operatively connected to said indicating lever;
2. means defining a self-contained energy package carried by the machine connected to said switch member; and
3. means interconnecting said energy package with said latching means for disengaging the latter from the donning mechanism upon actuation of said switch member by said indicating lever.

2. The spindle protection device according to claim 1 wherein said latching means includes a shaft member, a latching pawl fixed thereon, and a lever arm fixed on one end of said shaft in operative association with said disengaging means.

3. The spindle protection device according to claim 2 wherein said disengaging means comprises a solenoid.

4. The spindle protection device according to claim 3 wherein said self-contained energy package includes a 12 volt battery and circuitry connected thereto for energizing said solenoid upon actuation of said switch member.

* * * * *